United States Patent [19]

Kozek et al.

[11] Patent Number: 5,018,290

[45] Date of Patent: May 28, 1991

[54] EXIT SIGN

[75] Inventors: Edward P. Kozek, Woodbury; Charles R. Ruskouski, Danbury, both of Conn.; Steven J. Altamura, Scarsdale, N.Y.

[73] Assignee: Dual-Lite, Inc., Newtown, Conn.

[21] Appl. No.: 315,949

[22] Filed: Feb. 23, 1989

[51] Int. Cl.[5] ..... G09F 13/04

[52] U.S. Cl. ..... 40/570; 362/240; 362/812

[58] Field of Search ..... 40/570, 564, 541; 362/238, 240, 812

[56] References Cited

U.S. PATENT DOCUMENTS

| | | | |
|---|---|---|---|
| 3,309,806 | 3/1967 | Gallagher | 40/570 |
| 3,931,689 | 1/1976 | Shine | 40/570 |
| 4,006,546 | 2/1977 | Anderson et al. | 40/573 |
| 4,254,453 | 3/1981 | Mouyard et al. | 40/550 |
| 4,271,621 | 6/1981 | Garcia et al. | 40/572 |
| 4,383,382 | 5/1983 | Hegarty | 40/570 |
| 4,420,898 | 12/1983 | Moses | 40/570 |
| 4,435,743 | 3/1989 | Plumly | 40/570 |
| 4,443,835 | 4/1984 | Braütigam et al. | 362/812 |
| 4,466,208 | 8/1984 | Logan et al. | 40/570 |
| 4,544,910 | 10/1985 | Hoberman | 340/636 |
| 4,587,600 | 5/1986 | Morten | 362/219 |
| 4,650,265 | 3/1987 | Holtzman | 339/1 L |
| 4,682,147 | 7/1987 | Bowman | 40/570 |
| 4,724,629 | 2/1988 | Walton | 40/550 |
| 4,967,317 | 10/1990 | Plumly . | |

OTHER PUBLICATIONS

Crouse-Hinds Lighting Brochure.
Uniglow Canada, Inc. brochures.

*Primary Examiner*—Kenneth J. Dorner
*Assistant Examiner*—Brian K. Green
*Attorney, Agent, or Firm*—Ware, Fressola, Van Der Sluys & Adolphson

[57] ABSTRACT

In an exit sign, a plurality of rugged low voltage incandescent lamps are mounted on a printed circuit board to provide proper illumination. The lamps are positioned to provide indirect illumination to the "EXIT" stencilling of the exit sign. The exit sign can be adapted for use with both low voltage alternating current and low voltage emergency direct current. Because the lamps are driven at low voltage and are resistant to failure due to vibration, etc., they can be expected to attain a long life in service.

19 Claims, 6 Drawing Sheets

EXIT SIGN

BACKGROUND OF THE INVENTION

The present invention relates generally to illuminated exit signs and, more particularly, to illuminated exit signs equipped with a plurality of low voltage incandescent lamps.

Under current local fire and building codes, buildings to which the public has access are required to have signage therein identifying the exits. Most of these signs are required to exhibit a specific amount of illumination and, oftentimes, must have an emergency backup power source to provide emergency illumination to the light for a specified period of time during periods when power to the building is discontinued thereby facilitating egress of persons from the building.

Traditionally, two 15-watt incandescent lamps driven by one hundred twenty volt alternating current (120 VAC) have been employed to provide normal illumination while two 3.6-watt incandescent lamps driven by a self contained emergency battery power supply are used for illumination during power failure situations. A switching or transfer device will automatically operate the emergency backup illumination system when a power failure is detected.

While these traditional exit sign lighting arrangements perform adequately, they do have a few drawbacks. Firstly, the relatively high wattage bulbs consume large amounts of electrical energy, particularly, when the building has hundreds of such exit signs. Secondly, the bulbs generate heat and are subject to premature failure due to vibrations and the like requiring a considerable amount of maintenance to change the lamps. Finally, the traditional exit signs, employing the lower wattage lamps during emergency situations, do not provide the same amount of illumination as during normal operation with the larger wattage lamps.

It is an object of the present invention to provide a novel exit sign which uses a plurality low voltage incandescent lamps which consume low amounts of electrical energy and generate only small amounts of heat.

It is also an object to provide such a device having lamps which are not subject to premature failure due to vibrations and the like and therefore require low maintenance.

Still another object is to provide such a device which employs the same lamps during normal operation and emergency operation and thus the same amount of illumination in both situations.

A further object is to provide such an exit light which may be readily and economically fabricated and will enjoy a long life in operation.

SUMMARY OF THE INVENTION

It has now been found that the foregoing and related objects can be readily attained in an exit sign comprising a housing defining an enclosure therein and including a housing with indicia defined thereon, a printed circuit board mounted within the enclosure in a generally parallel arrangement with and spaced from the indicia, a plurality of low voltage incandescent lamps mounted in a desired pattern on the printed circuit board to fully illuminate indicia in a uniform manner, and an electric power supply operationally connected to the printed circuit board for supplying power to the low voltage incandescent lamps.

Desirably, the housing with the indicia defined thereon includes a visible area through which light can pass from the low voltage incandescent lamp so as to make the visible area visible outside the enclosure and a masked area which blocks light from the incandescent lamps from passing outside the enclosure. The low voltage incandescent lamps are arranged in the desired pattern whereby the lamps are located directly behind the masked area. A diffuser is mounted in the housing located between the indicia and the printed circuit board whereby light from the incandescent lamps passes through the diffuser before passing out of the housing through the visible areas.

According to the invention, the printed circuit board has apertures in which the incandescent lamps are mounted. The apertures extend entirely through the printed circuit board to permit light from the incandescent lamps to emanate on both sides of the printed circuit board. The indicia of the housing are located on both sides of the printed circuit board so light emanating form the incandescent lamps will emanate from both sides of the housing. The printed circuit board has a reflective surface on both sides thereof to reflect light from the incandescent lamps.

Ideally, the electrical power supply is an alternating current power supply. The electrical power supply further includes an emergency direct current power supply and a switching device for switching between the two power supplies if the alternating current power supply fails. A releasably detachable connector is provided to the power supply so as to facilitate connection to the printed circuit board.

In yet still another feature, the printed circuit board and the incandescent lamps are an integral unit releasably mounted in the housing to facilitate replacement thereof. The housing has a generally rectangular shape including top and bottom walls, a pair of sidewalls and a pair of endwalls. The printed circuit board is mounted in the enclosure with its major surfaces generally parallel to the sidewalls of the housing.

Conveniently, the housing is a two-part construction with the two parts hingedly connected together. The printed circuit board is releasably mounted in one of the two parts. A bracket is releasably connected to one of the two parts and is provided for mounting the sign to a flat surface.

The invention will be fully understood when reference is made to the following detailed description taken in conjunction with the accompanying drawings.

DETAILED DESCRIPTION OF THE PREFERRED EMBODIMENT

Figure 1:
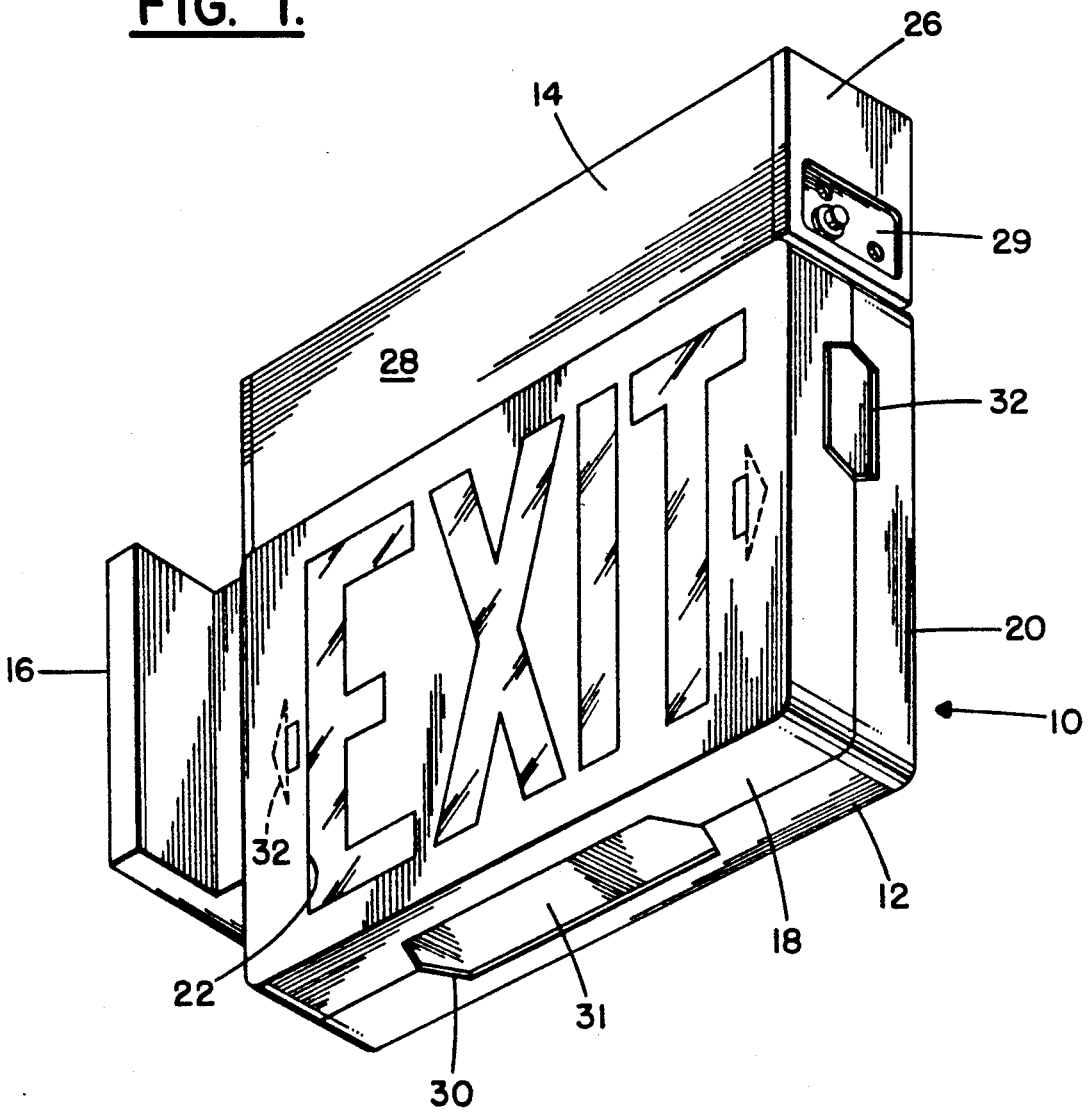
FIG. 1 is a perspective view of an exit sign embodying the present invention.

Referring first to FIG. 1 of the drawings, therein illustrated is the exit sign construction of this invention generally designated by the numeral 10. The exit sign 10 has an exit sign housing 12 shown with auxiliary power supply 14 mounted to the top thereof, and a canopy bracket 16 mounted to the side thereof. With this arrangement, the exit sign construction of this invention can be mounted directly to a sidewall of a building in any desired location.

In an alternative arrangement (not shown) of the exit sign construction of this invention, the auxiliary power supply 14 can be mounted to the top of housing 12, while bracket 16 is mounted to the top of the auxiliary power supply 14. With this arrangement, the exit sign construction of this invention can be mounted directly to a ceiling of a building in any desired location. In addition, the unit can be adapted for flush mounting on a side wall directly to an electrical junction box.

The exit sign housing 12 comprises mating front and back housing members 18 and 20 each of which incorporate a large stencil 22 and 24 having the letters "EXIT" in the major surfaces thereof. Auxiliary power supply 14 comprises a container 26 and an interfitting, locking cover 28. The auxiliary power supply 14 includes a test unit 29 used in order to check the operability of the supply 14. The exit sign construction 10 of the present invention can be used without the auxiliary power supply 14 if desired.

The housing members 18 and 20 are cast from aluminum and interfit forming an opening 30 in the bottom thereof to provide downlighting from the exit sign 10. The opening 30 is closed by a clear plastic lens 31 secured to the inside of housing member 20. The housing 12 is provided with punch or knock out areas 32 so that the exit sign 10 can be adapted for use in any emergency lighting situation. The punch out areas 32 include removable direction arrows on both sides of the "EXIT" stencils 22, 24. Removable arrows are included in order to allow the precise location of the exit to be clearly indicated. They are manufactured to allow quick and easy removability when desired.

Figure 2:
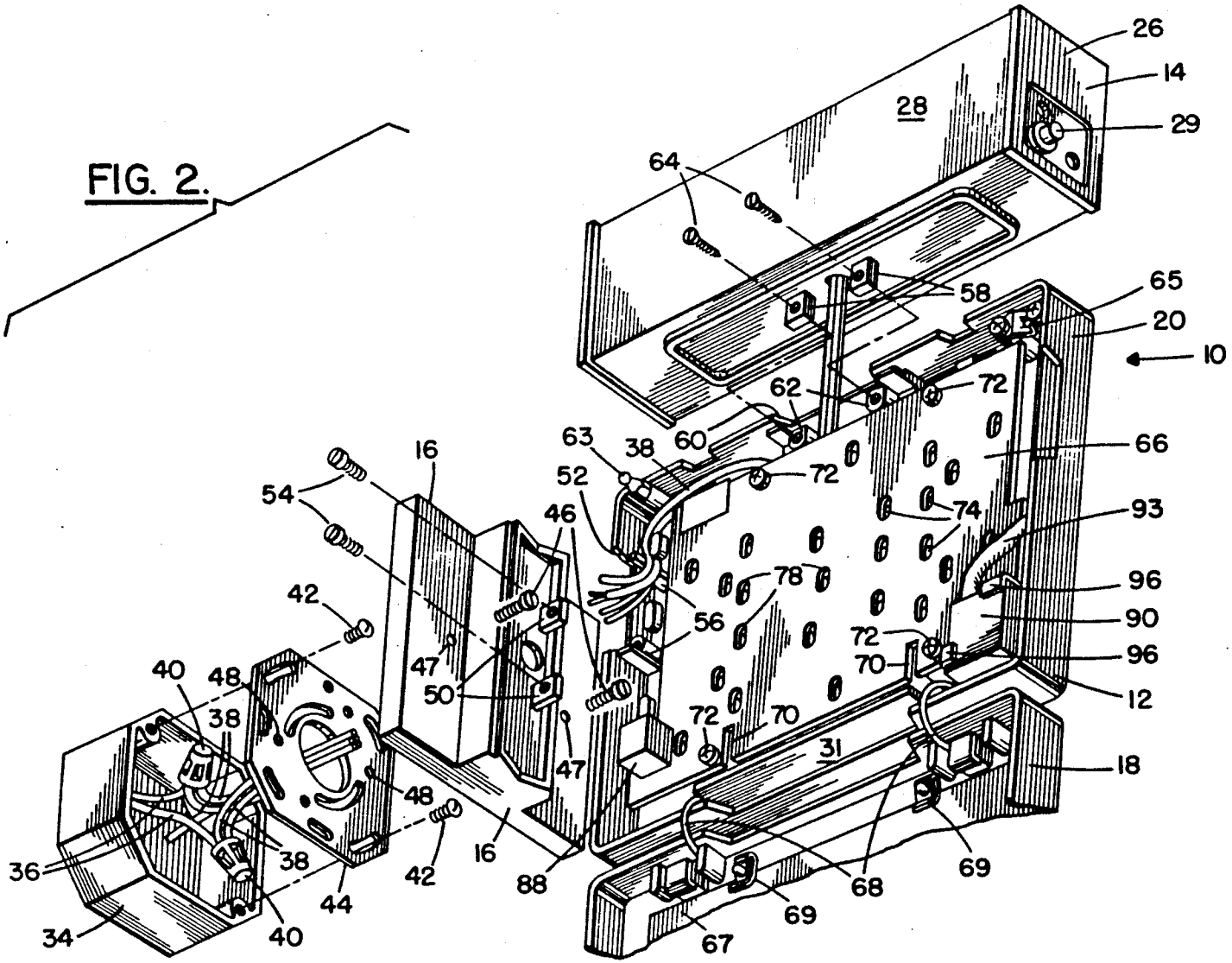
FIG. 2 is an exploded perspective view of the exit sign with one of the housing members pivoted to its open position to illustrate internal structure.
Figure 5:
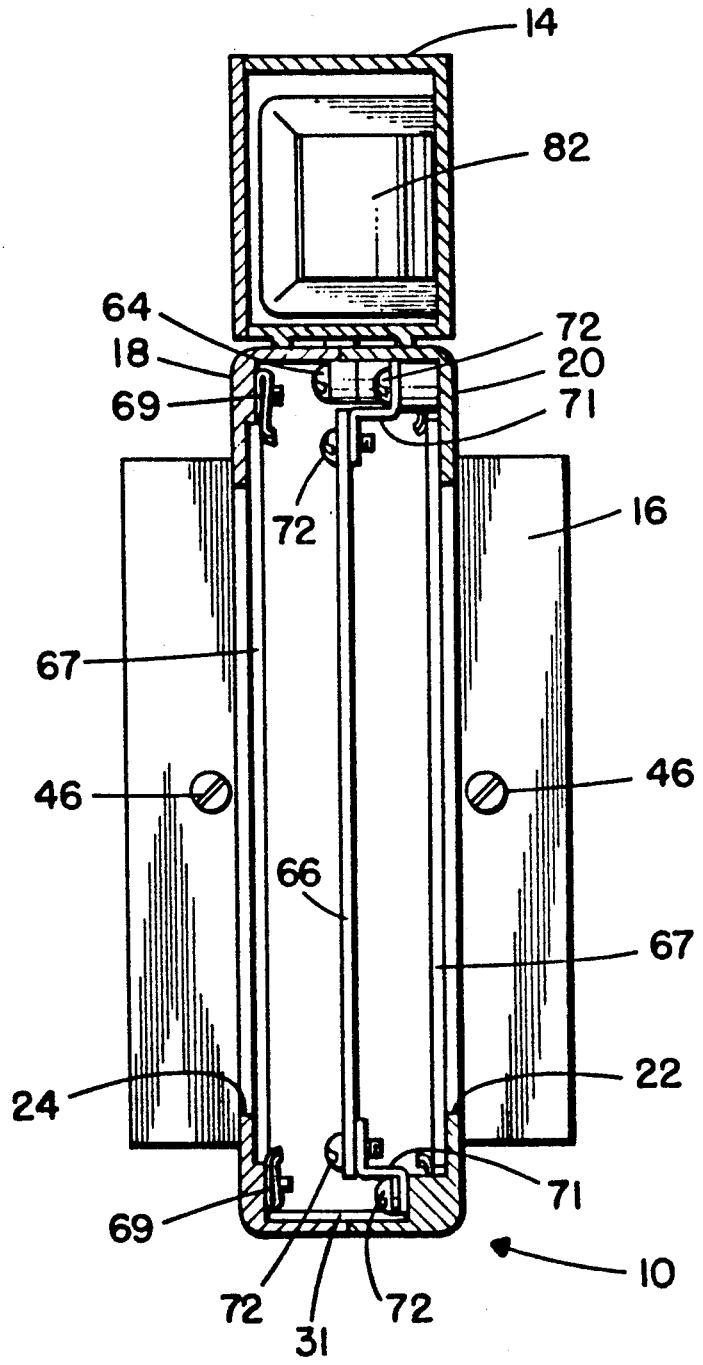
FIG. 5 a cross-sectional view of the exit sign of the present invention taken along the 5—5 line of FIG. 3.

Referring now to FIGS. 2 and 5, the internal structure of the exit sign 10 can be better understood as the exit sign 10 is shown in a partially exploded, open condition and also in cross-section. The exit sign 10 is mounted to an electrical box 34 located in the sidewall of the building (not shown). The electrical box 34 provides access to the electrical leads 36 carrying standard one hundred twenty volt alternating current (120 VAC). The exit sign construction of the present invention can also be powered by two hundred seventy-seven volt alternating current (277 VAC). The leads 36 are in turn connected to the electrical leads 38 of the exit sign 10 utilizing wire nuts 40 in a well-known manner. The electrical leads 38 extend through the universal mounting plate 44 and the canopy bracket 16 to the electronic circuitry of the exit sign 10 as will be explained further hereinafter. Secured to the electrical box 34 by screws 42 is a universal mounting plate 44 onto which is mounted the canopy bracket 16. Screws 46 extend through apertures 47 in the canopy bracket 16 and threadingly interconnect with the universal mounting plate 44 via a pair of threaded apertures 48 therein.

The canopy bracket 16 has a pair of spaced apertured lugs 50 thereon which extend into the interior of the housing 12 of the exit sign 10 through an opening 52 therein to be retained by screws 54 received by threaded bosses 56. Similarly, apertured lugs 58 of the auxiliary power supply 14 extend through opening 60 and are connected to threaded bosses 62 by screws 64.

In FIG. 2, the exit sign housing 12 is illustrated with the front housing member 18 pivoted away from the back housing member 20 to reveal the internal structure and the electronic circuitry including a printed circuit board 66 for the exit sign 10. The front and back housing members 18 and 20 are hingedly connected to one another by hinges 68 which fit into slots 70 in the printed circuit board 66 when the housing 12 is in its closed position.

The front and back housing members 18 and 20 are releasably retained when in their closed position by a mating closure arrangement. The closure arrangement on the back housing member 20 is provided by nipple member 63 and spring clip 65. A similar arrangement incorporated on the front housing member 18 allows capture of the nipple 63 in a spring clip (not shown) on the front housing member 18 and mating of the spring clip 65 with a nipple (not shown) on the front housing member 18.

To assure the high visibility of the "EXIT" letters on the front and back housing members 18 and 20, a pair of diffuser plates 67 (See FIGS. 2 and 5) is employed. Each diffuser plate 67 is preferably a fiberglass-reinforced, translucent plastic in a color complying with local codes, most usually red. Retaining clips 69 are employed to securely lock the diffuser plates 67 in their proper position. The completely assembled exit sign housing 12 of this invention with the diffuser plates employed in both the front and rear panels is shown in FIG. 5. In a flush mounting construction wherein back stencil 24 is not used, a rear diffuser plate is not required.

Figure 3:
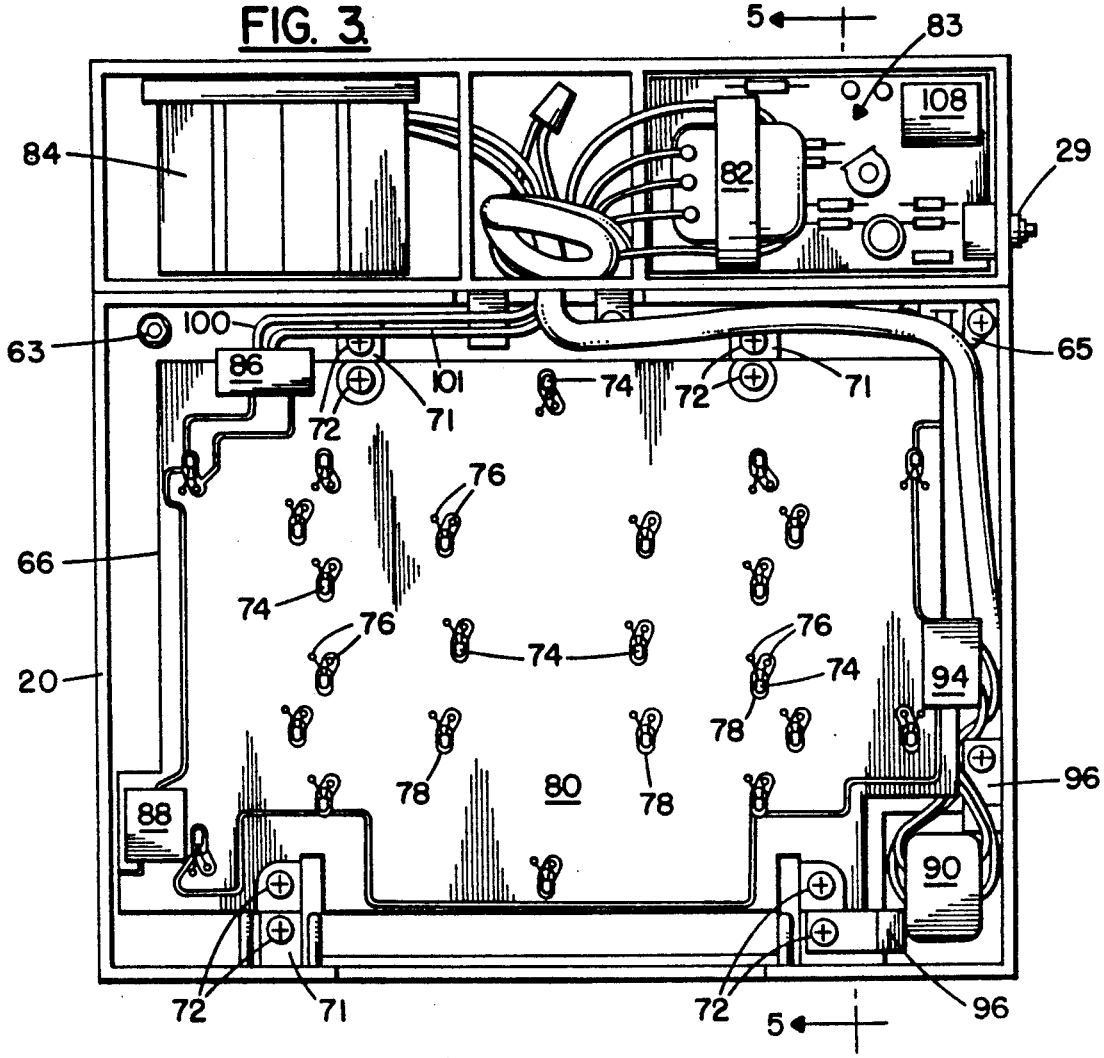
FIG. 3 is a side elevational view of the exit sign housing showing one of the housing members with the direct current emergency power pack and printed circuit board mounted thereto, some parts are removed and others broken away for clarity of illustration.
Figure 4:
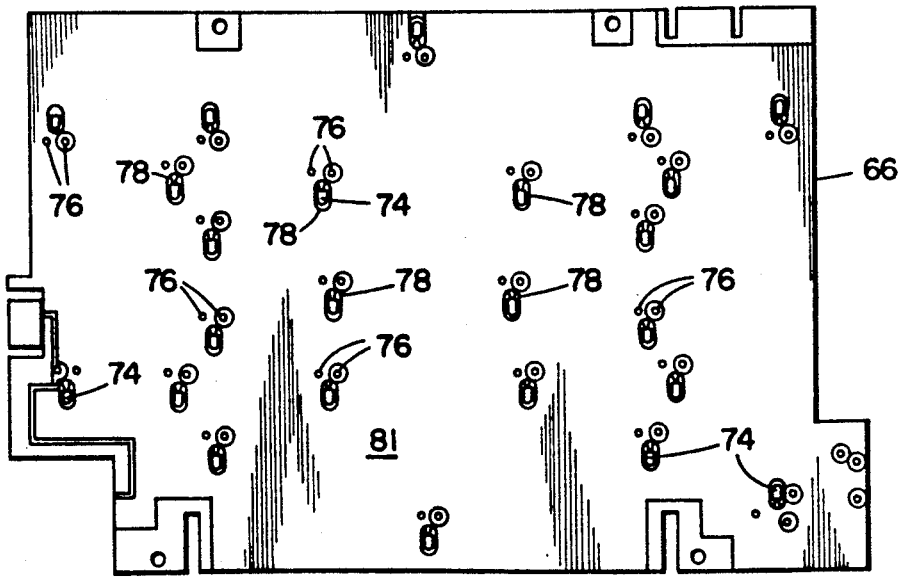
FIG. 4 a side elevational view of the printed circuit board.

As best seen in FIGS. 3 and 5, the printed circuit board 66 is mounted to the back housing member 20 by Z-shaped brackets 71 and screws 72 using threaded bosses (not shown) on the housing member 20. The printed circuit board 66 is plated with reflective conductive material for supplying electrical power to a plurality of individual lamps 74 mounted thereon. The lamps 74 are low cost, low voltage, two pin lamps (5 volt, 0.115 amp, size T-1) electrically connected to the circuit board 66 via through holes 76 and are capable of being driven by both alternating and direct currents. The lamps 74 are set into apertures 78 so that they can illuminate both of the stencils 22 and 24 on either side of printed circuit board 66. The flip side of the printed circuit board 66 is shown in FIG. 4. As will be explained in further detailed hereinafter, the plating patterns 80, 81 on the circuit board are carefully planned so that the lamps 74 can be energized by either alternating or direct current. Because the lamps 74 have a rugged filament resistant to break down from vibration, etc. and are driven at low voltage, the lamps 74 are expected to have a life expectancy between seven and twenty-five years depending on operating environment.

The electrical leads 38 are wired into a transformer 82 which powers the standard battery-charging circuitry 83 used to charge a four volt (4V) battery 84. The battery 84 is wired to charging circuitry 83 which is in turn wired into the printed circuit board 66 to provide power thereto via connector 86. In a well-known manner, a single pole, double throw transfer relay 88 completes the direct current auxiliary power circuit by providing switching capability to power the exit sign 10 using the auxiliary power supply 14 should the alternating current supply fail.

The electrical leads 38 are also wired to a transformer 90 through a fiberglass or thermoplastic sheath 93 as required by Underwriters Laboratories. The transformer 90 steps down the one hundred twenty volt alternating current (120 VAC) to 4.05 volt alternating current (4.05 VAC). This low voltage transformer 90 is connected to the printed circuit board through a connector 94. The transformer 90 is held in place in the back housing member 20 by Z-shaped brackets 96.

Figure 6:
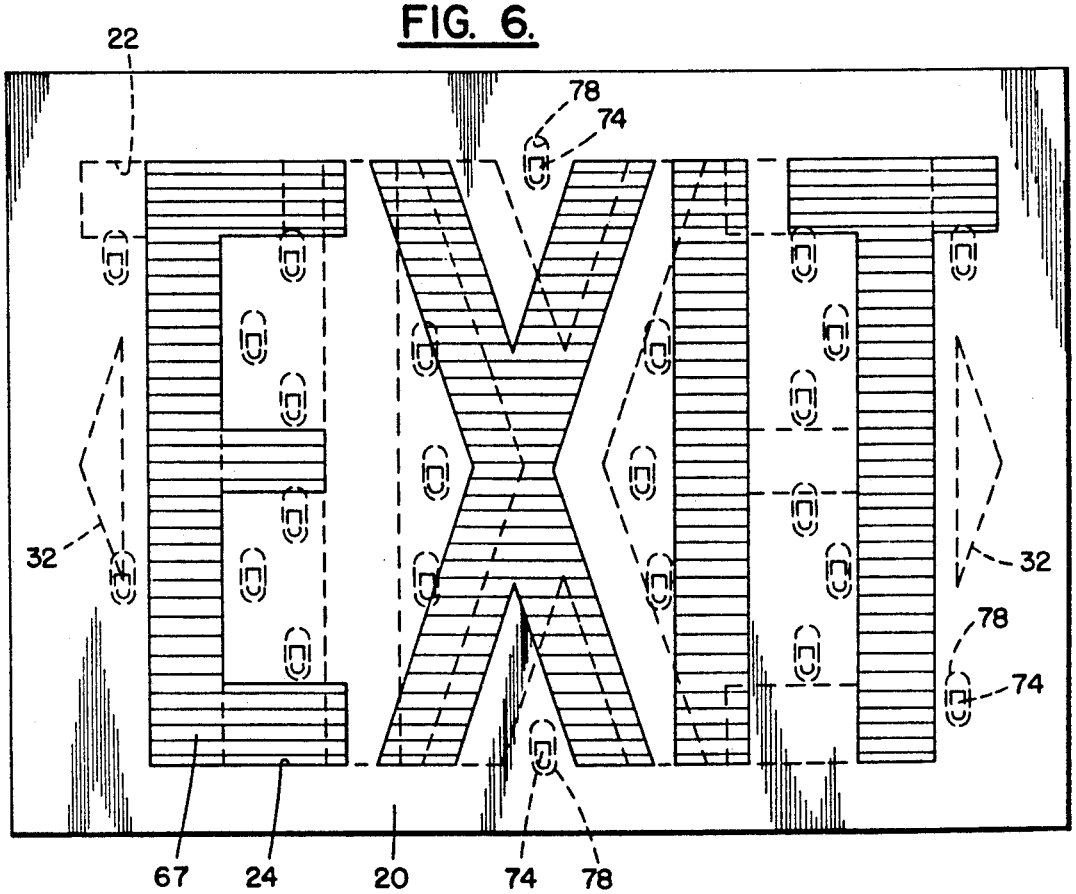
FIG. 6 a side elevational view showing the placement of the small incandescent lamps relative to the stencils on the housing members of the exit sign of the present invention; an FIG. 7 is a circuit diagram of the electronic components of the present invention.

With particular reference to FIG. 6, the layout for the low voltage lamps 74 can be readily appreciated. The layout provides both sufficient illumination and an attractive lit display without "hot spots" of illumination. To achieve this, a sufficient number of lamps 74 are located within the exit sign 10 to provide the illumination necessary to meet at least the minimum standards set by the National Fire Protection Association (NFPA), Life Safety code (101) and Underwriters Laboratories. The lamps 74 are offset from the stencils 22, 24 so the areas of intense illumination are not in direct alignment therewith thereby avoiding "hot spots" or areas of unattractive intense illumination. The printed circuit board has a reflective surface from plating patterns 80, 81 (FIGS. 3–4) so as to increase the illumination of the exit sign 10.

Figure 7:
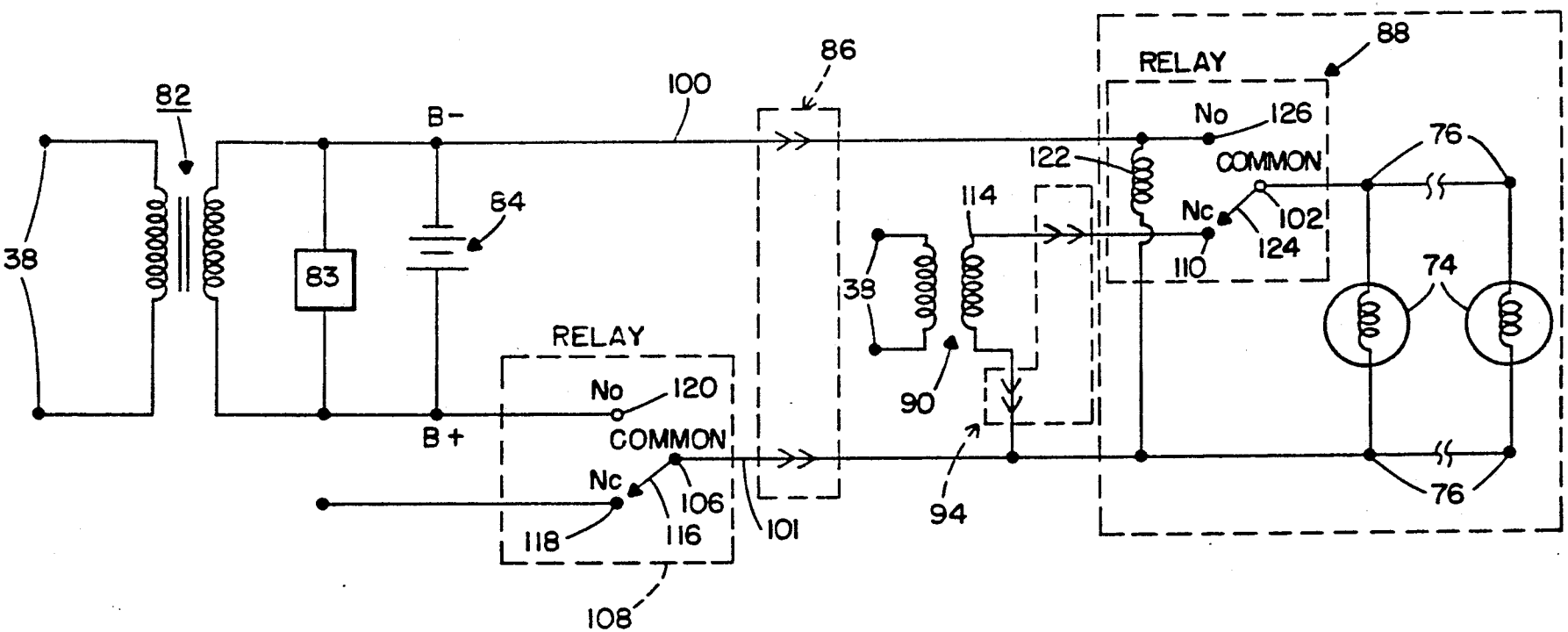

As best seen in FIG. 7, lamps 74 are connected in parallel at one side to the common contact 102 of relay 88. The other side of each lamp is connected in parallel to the common contact 106 of relay 108.

As seen in FIG. 7, the normally closed contact 110 of relay 88 is connected to one side of the 4.05 VAC secondary output of transformer 90. The other side of secondary winding 114 is connected to the common terminal 106 of relay 108.

When alternating current power is present, the coil (not shown) of relay 108 is deenergized and thus wiper 116 of that relay 108 is connected to the normally closed contact 118, which in turn is electrically isolated from the remaining circuitry. In this situation the primary of transformer 90 provides power to the secondary of the transformer 90 which in turn presents the 4.05 VAC to the normally closed contact 110 of relay 88 thus energizing lamps 74 with the 4.05 VAC power, through connector 94 and the plating patterns 80, 81 on the printed circuit board 66.

When a power outage occurs or when the test unit 29 of the exit sign 10 is activated, the coil of relay 108 is energized causing wiper 116 to contact the normally open terminal 120 of that relay 108. This terminal is connected to the positive battery voltage (B+) which is then effectively connected across coil 122 of relay 88 since the coil is connected at its other side to the negative battery voltage (B−). The energization of coil 122 causes wiper 124 to contact the normally open terminal 126 of relay 88 thereby providing battery voltage across lamps 74 through connector 86 and the plating patterns 80, 81 on the printed circuit board 66. It is also evident in FIG. 7 that the secondary winding 114 of transformer 90 is isolated from the battery voltage and thus does not provide any drain to the battery during emergency operation of the exit sign.

Finally, when battery operation of the exit sign is not present, i.e., signs with only AC power, a jumper (not shown) is placed between the normally closed contact 110 and the common contact 102 of relay 88 thereby ensuring connection of the 4.05 VAC power to the lamps 74.

It will therefore be seen from the above that the present invention provides an exit sign which produces maximum illumination from low voltage incandescent lamps, using both direct and alternating currents.

It will thus be seen that the objects set forth above, among those made apparent from the preceding description, are efficiently attained and, since certain changes may be made in the above product without departing from the scope of the invention, it is intended that all matter contained in the above description or shown in the accompanying drawings shall be interpreted as illustrative and not in a limiting sense.

It is also to be understood that the following claims are intended to cover all of the generic and specific features of the invention herein described, and all statements of the invention which, as a matter of language, might be said to fall therebetween.

Having thus described the invention, what is claimed is:

1. An exit sign assembly comprising:

A. a housing defining an enclosure therein and including means defining indicia thereon;

B. a printed circuit board mounted within said enclosure in a generally parallel arrangement with and spaced from said indicia defining means;

C. a plurality of low voltage incandescent lamps mounted in a desired pattern on said printed circuit board to fully illuminate said indicia of said indicia defining means in a uniform manner, said indicia defining means includes a visible area through which light can pass from said low voltage incandescent lamps so as to make the visible area visible outside said enclosure and a masked area which blocks light from said incandescent lamps from passing outside said enclosure, said low voltage incandescent lamps are arranged in said desired pattern whereby said lamps are located directly behind said masked area so that an imaginary line passing through any one of said low voltage incandescent lamps normal to said indicia defining means intersects said indicia defining means only in said masked area; and D. an electric power supply operationally connected to said printed circuit board for supplying power to said low voltage incandescent lamps.

2. The exit sign assembly in accordance with claim 1 further including a diffuser spaced between said indicia defining means and said printed circuit board whereby light from said incandescent lamps passes through said diffuser before passing out of said housing through said visible areas.

3. The exit sign assembly in accordance with claim 1 wherein said printed circuit board has apertures in which said incandescent lamps are mounted.

4. The exit sign assembly in accordance with claim 3 wherein said apertures extend entirely through said printed circuit board to permit light from said incandescent lamps to emanate on both sides of said printed circuit board.

5. The exit sign assembly in accordance with claim 3 wherein said printed circuit board has a reflective surface on both sides thereof to reflect light from said incandescent lamps.

6. The exit sign assembly in accordance with claim 1 wherein said electrical power supply is an alternating current power supply.

7. The exit sign assembly in accordance with claim 6 wherein said electrical power supply further includes an emergency direct current power supply and a switching device for switching between said alternating current power supply and said emergency direct current power supply if said alternating current power supply fails.

8. The exit sign assembly in accordance with claim 1 wherein said electrical power supply is provided with a releasably detachable connector so as to facilitate connection to said printed circuit board.

9. The exit sign assembly in accordance with claim 1 wherein said printed circuit board and said incandescent lamps are an integral unit releasably mounted in said housing to facilitate replacement thereof.

10. The exit sign assembly in accordance with claim 1 wherein said housing has a generally rectangular shape including top and bottom walls, a pair of sidewalls and a pair of endwalls.

11. The exit sign assembly in accordance with claim 10 wherein said side walls are parallel to one another and said printed circuit board is mounted within said enclosure with its major surfaces generally parallel to said sidewalls of said housing.

12. The exit sign assembly in accordance with claim 1 wherein said housing is of two part construction with said two parts hingedly connected together.

13. The exit sign assembly in accordance with claim 12 wherein said printed circuit board is releasably mounted in one of said two parts.

14. The exit sign assembly in accordance with claim 12 further including a bracket for mounting said sign to a flat surface, said bracket being releasably connected to said one of said two parts.

15. The exit sign assembly in accordance with claim 1 wherein said printed circuit board has a reflective surface thereon for reflecting light from said incandescent lamps.

16. An exit sign assembly comprising:

A. a housing defining an enclosure therein and including means defining indicia thereon;

B. a printed circuit board mounted within said enclosure in a generally parallel arrangement with and spaced from said indicia defining means, said printed circuit board has apertures extending entirely therethrough;

C. a plurality of low voltage incandescent lamps mounted in a desired pattern with in said apertures on said printed circuit board to permit light from said incandescent lamps to emanate on both sides of said printed circuit board to fully illuminate said indicia of said indicia defining means in a uniform manner, said indicia defining means of said housing is located on both sides of said printed circuit board so light emanating from said incandescent lamps will emanate from both sides of said housing; and D. an electric power supply operationally connected to said printed circuit board for supplying power to said low voltage incandescent lamps.

17. The exit sign assembly in accordance with claim 16 wherein said indicia defining means includes a visible area through which light can pass from said low voltage incandescent lamps so as to make the visible area visible outside said enclosure and a masked area which blocks light from said incandescent lamps from passing outside said enclosure.

18. The exit sign assembly in accordance with claim 17 wherein said low voltage incandescent lamps are arranged in said desired pattern whereby said lamps are located directly behind said masked area.

19. The exit sign assembly in accordance with claim 18 further including a diffuser spaced between said indicia defining means and said printed circuit board whereby light from said incandescent lamps passes through said diffuser before passing out of said housing through said visible areas.

* * * * *